US006730871B1

(12) United States Patent
Loebner

(10) Patent No.: US 6,730,871 B1
(45) Date of Patent: May 4, 2004

(54) COMPRESSED GAS-BLAST CIRCUIT BREAKER

(75) Inventor: Friedrich Loebner, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/148,271

(22) PCT Filed: Oct. 11, 2000

(86) PCT No.: PCT/DE00/03616

§ 371 (c)(1),
(2), (4) Date: May 29, 2002

(87) PCT Pub. No.: WO01/33594

PCT Pub. Date: May 10, 2001

(30) Foreign Application Priority Data

Nov. 3, 1999 (DE) ..... 199 53 560

(51) Int. Cl.[7] ..... H01H 33/53

(52) U.S. Cl. ..... 218/66; 218/59; 218/63

(58) Field of Search ..... 218/43, 47, 50, 218/51–54, 59, 60–65, 72, 73

(56) References Cited

U.S. PATENT DOCUMENTS

| | | | | |
|---|---|---|---|---|
| 3,984,651 A | | 10/1976 | Lewis et al. | |
| 4,237,356 A | * | 12/1980 | Ragaller | 218/62 |
| 5,001,314 A | * | 3/1991 | Thuries et al. | 218/70 |
| 5,808,257 A | * | 9/1998 | Thuries | 218/60 |

FOREIGN PATENT DOCUMENTS

| | | | | |
|---|---|---|---|---|
| FR | 2 760 890 A1 | | 9/1998 | |
| FR | 2760890 A1 | * | 9/1998 | H01H/33/53 |

* cited by examiner

*Primary Examiner*—Marina Fishman
(74) *Attorney, Agent, or Firm*—Morrison & Foerster LLP

(57) ABSTRACT

A hollow contact tube is provided in a compressed gas-blast circuit breaker in order to improve dielectric properties. The outlet (6) of said contact tube cooperates with a deflecting body (9) and is surrounded by a fixed substantially hollow cylindrical flow director (8).

4 Claims, 2 Drawing Sheets

COMPRESSED GAS-BLAST CIRCUIT BREAKER

CLAIM FOR PRIORITY

This application claims priority to German patent application no. 199 53 560.4 which was filed on Nov. 3, 1999.

1. Technical Field of the Invention

The invention relates to a circuit breaker having a contact tube which is hollow in order to carry away hot switching gases and bounds the breaker gap, and whose outlet opening interacts with a stationary guide body which is arranged at a distance from it.

2. Background of the Invention

A circuit breaker is described, for example, from Laid-Open Specification DE 39 04 439 A1. In the known arrangement, which is intended by way of example for 145 kV, the hot switching gases which are produced in an arc in the breaker gap during a disconnection process are carried away through the interior of a stationary contact tube. In this case, the hot switching gases are passed out of an outlet opening of the contact tube to a stationary guide body. In the known arrangement, the contact tube is arranged such that it is stationary, so that the distance between the outlet opening and the guide body always remains the same, resulting in a constant, guided gas flow.

In order to achieve better dielectric strength for the breaker gap in the circuit breaker, it is desirable for the distance between the contact which bound the breaker gap to be made as large as possible during the disconnection process. In the known arrangement, the separating gap can be enlarged during the disconnection process only by lengthening the operating travel of the moving contact.

SUMMARY OF THE INVENTION

The present invention discloses, in one embodiment, a circuit breaker such that the separating gap is enlarged in the disconnected position without lengthening the operating travel of the moving contact, and without adversely affecting the way in which the hot switching gases are carried away.

In one aspect of the invention, a contact tube is guided such that it can move axially, and the outlet opening is surrounded by a stationary nozzle-shaped flow guide in every position of the contact tube during the movement.

The capability of the contact tube to move axially makes it possible, in a simple manner, to enlarge the separating gap in the circuit breaker in the disconnected position, with the stationary flow guide guiding the flow of hot switching gases independently of the position of the contact tube, and hence independently of its outlet opening. The guide body and the nozzle-shaped flow guide are separated from one another by the same distance. It is thus possible in conjunction with the guide body and the flow guide to ensure that the same boundary conditions are provided for the flow of switching gases.

It is advantageously possible to provide for the flow guide to be composed at least partially of an insulating material.

A further advantageous embodiment provides for the guide body to be composed at least partially of an insulating material.

If the flow guide and the guide body, or one of the two, is at least partially comprised of a suitable insulating material, then it is possible to reduce the electrical conductivity of the hot switching gases as well, if, for example, PTFE is chosen, which releases electrically negative gas components under the influence of hot switching gases. The flow guide and guide body may be formed from a number of parts. In this case, it is possible for the individual pieces to be composed of different materials.

BRIEF DESCRIPTION OF THE DRAWINGS

In the following text, the invention will be illustrated with reference to a drawing, and the method of operation will be described in more detail.

DETAILED DESCRIPTION OF THE PREFERRED EMBODIMENTS

Figure 1:
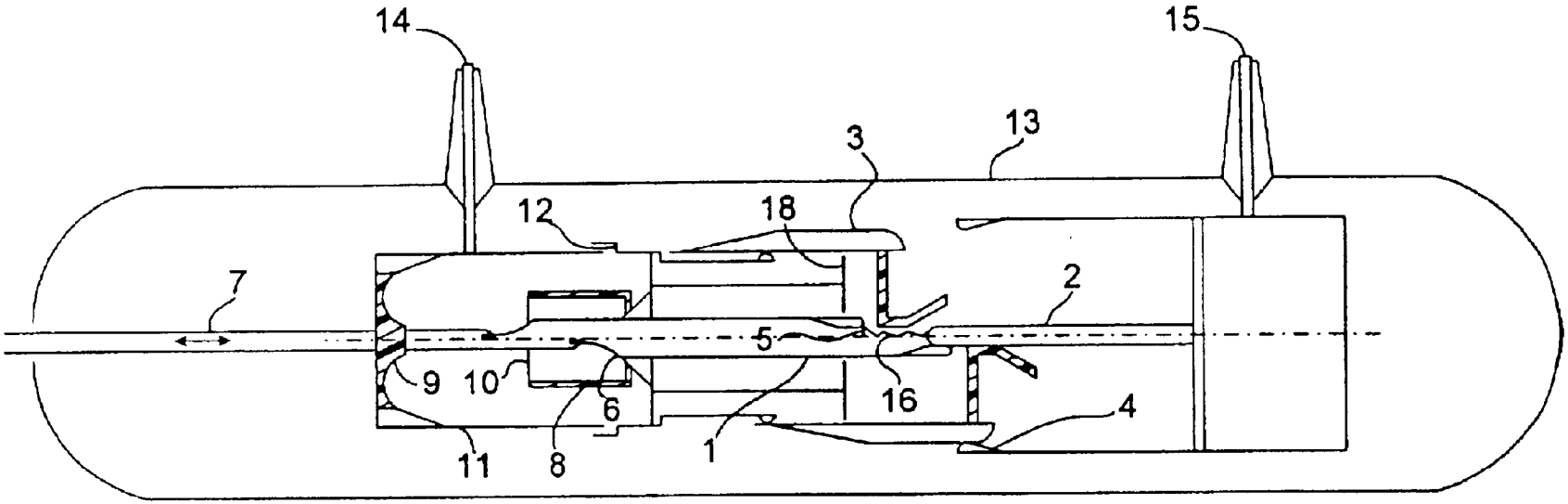
FIG. 1 shows the schematic design of an interrupter unit in a circuit breaker.

FIG. 1 shows the schematic design of an interrupter unit in a high-voltage circuit breaker. The connected position of the interrupter unit is shown underneath the line of symmetry, and the disconnected position is shown above the line of symmetry. The circuit breaker has a first and a second arcing contact 1, 2, which are surrounded by a first and a second rated current contact 3, 4. The first arcing contact 1 is in the form of a hollow contact tube. At its first free end, it has an inlet flow opening 5, while an outlet opening 6 is provided at its second free end. The drive for the circuit breaker is coupled by a switching rod 7 to the second free end of the first arcing contact 1, and the movement of this drive moves the first arcing contact 1 and the first rated current contact 3 axially. An exxentially hollow-cylidrical flow guide 8 is arranged in the fixed position radially around the outlet opening 6 of the first arcing contact 1. A conical guide body 9 is arranged opposite the opening 10 of the flow guide 8.

The drive-side part of the interrupter unit is surrounded by an outlet flow chamber 11. This outlet flow chamber 11 has outlet flow openings 12. The wall of the outlet flow chamber 11 is comprised of an electrically conductive material, which is used to conduct the electric current. The interrupter unit of the high-voltage circuit breaker is surrounded by gas-tight encapsulation 13, which is filled with an insulating gas, in particular $SF_6$.

A first and a second electrical connection 14, 15, as well as the switching rod 7, are passed in a gas-tight manner through the encapsulation 13.

Figure 2:
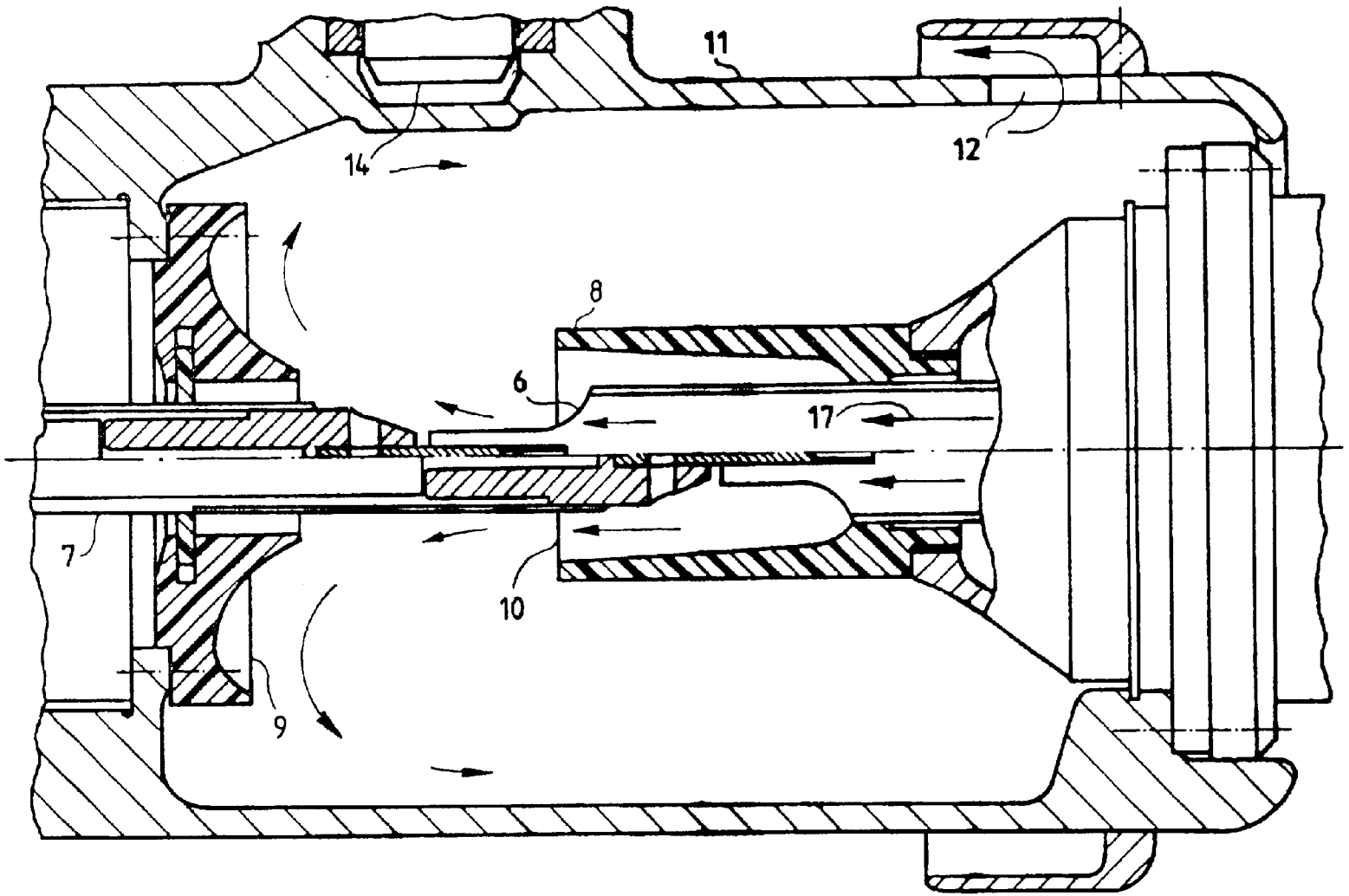
FIG. 2 shows a drive-side detail of the interrupter unit.

FIG. 2 shows a detail of the drive side of the interrupter unit, with the position of the arrangement at the start of the disconnection process being shown underneath the line of symmetry, and with the position at the end of the disconnection process being shown above the line of symmetry.

The disconnection process starts with the separation of the rated current contacts 3, 4 and, as the disconnection process continues, the arcing contacts 1, 2 are separated, with an arc 16 being struck between them. This arc 16 heats, expands and ionizes the quenching gas. In order to quench the arc 16 and to remove the hot quenching gas from the separating gap, additional quenching gas flows through the separating gap. The additional flow through the separating gap can be produced, for example, by a compression apparatus 18. Part of the quenching gas, whose pressure has been raised, is passed through the inlet flow opening 5 in the first free end of the first arcing contact 1, and is carried away in the interior of the first arching contact 1, by virtue of the tubular configuration of said first arcing contact 1. At the second free end of the first arcing contact 1 there is an outlet opening 6, which makes it possible for the quenching gas to emerge from the first arcing contact 1, which is in the form of a contact tube.

At the start of the disconnection movement, the outlet opening 6 in the second free end of the first arcing contact 1 projects entirely beyond the flow guide 8 in the direction of the guide device 9. The hot switching gases 17 emerge from the outlet opening 6 and are guided by the flow guide 8 in the direction of the guide body 9. This prevents a radial, swirling outlet flow. As the disconnection movement continues, the first arcing contact 1 is moved in the direction of the fixed-position guide body 9. The outlet opening 6 in the second free end of the first arcing contact 1 likewise moves in the direction of the guide body 9, while the flow guide 8, which is mounted in a fixed position, is not subjected to any movement. The interaction of the flow guide 8 and of the guide body 9 means that, despite the change in the position of the outlet opening 6, the hot switching gas 17 is still directed onto the guide body 9. After passing the guide device 9, the quenching gas flows in the direction of the outlet flow opening 12 of the outlet flow chamber 11. The flow guide 8 ensures that the switching gases 17 are carried uniformly, very largely independently of the movement of the contact tube, within the outlet flow chamber 11.

If the flow guide 8 and the guide body 9 are comprised of PTFE, the insulating material is dissociated under the influence of the hot temperatures of the switching gas 17, with electrically negative components being released from the insulating material. These electrically negative components reduce the electrical conductivity to an advantagoues extent. The dielectric characteristics of the switch are improved by the deliberate guidance of the quenching gas flow, and the enrichment of the quenching gas flow.

What is claimed is:

1. A circuit breaker, comprising:

a contact tube which is hollow, carries away hot switching gases and bounds a breaker gap; and an outlet opening interacting with a stationary guide body which is arranged at a distance therefrom and disposed at an end opposite from the breaker gap, wherein the contact tube is guided such that the contact tube can move axially, and the outlet opening is surrounded by a stationary nozzle-shaped flow guide in each position of the contact tube during the movement.

2. The circuit breaker as claimed in claim 1, wherein the flow guide is at least partially comprised of an insulating material.

3. The circuit breaker as claimed in claim 1, wherein the guide body is at least partially comprised of an insulating material.

4. The circuit breaker as claimed in claim 2, wherein the guide body is at least partially comprised of an insulating material.

* * * * *